US006382244B2

(12) United States Patent
Vann

(10) Patent No.: US 6,382,244 B2
(45) Date of Patent: May 7, 2002

(54) RECIPROCATING PUMP STANDING HEAD VALVE

(76) Inventor: Roy R. Vann, 9517 Tosha La., Flint, TX (US) 75762

( * ) Notice: Subject to any disclaimer, the term of this patent is extended or adjusted under 35 U.S.C. 154(b) by 0 days.

(21) Appl. No.: 09/911,231

(22) Filed: Jul. 23, 2001

Related U.S. Application Data

(60) Provisional application No. 60/220,361, filed on Jul. 24, 2000.

(51) Int. Cl.[7] ..... F16K 15/04

(52) U.S. Cl. ..... 137/515; 137/512.5

(58) Field of Search ..... 137/539, 539.5, 137/512.3, 512.1, 515; 417/555.2

(56) References Cited

U.S. PATENT DOCUMENTS

| | | | | | |
|---|---|---|---|---|---|
| 880,019 | A | * | 2/1908 | Futhey | 417/555.2 |
| 1,771,690 | A | * | 7/1930 | Rankin | 417/55.2 |
| 2,690,134 | A | * | 9/1954 | Ritchey | 417/555.2 |
| 2,949,861 | A | | 8/1960 | Heath | 103/179 |
| 3,379,137 | A | * | 4/1968 | Harder | 417/555.2 |
| 4,599,054 | A | * | 7/1986 | Spears | 417/456 |
| RE33,163 | E | | 2/1990 | Madden | 417/444 |
| 5,382,142 | A | * | 1/1995 | Spears | 137/522 |
| 5,533,876 | A | * | 7/1996 | Nelson, II | 417/456 |

* cited by examiner

*Primary Examiner*—Michael-Powell Buiz
*Assistant Examiner*—Meredith H. Schoenfeld
(74) *Attorney, Agent, or Firm*—C. W. Alworth

(57) ABSTRACT

A circular check valve with a central aperture is disclosed. The preferred use as a standing head valve for reducing hydrostatic pressure in a wellbore being produced by a reciprocating pump is discussed. In this application the circular check valve allows the a sucker rod, or equivalent source of pumping energy, to pass. The device is attached to the pump barrel in communication with pump chambers and the production tubing. The check valve device isolates the pump internals and the formation from the hydrostatic head of the produced fluid. The device eliminates pump-off and thus fluid pounding resulting in more efficient pumping and less maintenance. Other uses for the circular check are described.

15 Claims, 9 Drawing Sheets

RECIPROCATING PUMP STANDING HEAD VALVE

This application claims priority from Provisional Patent Application 60/220,361 filed on Jul. 24, 2000.

The present invention relates generally to the oil and gas industry and in particular to stripper well production utilizing reciprocating pumps.

BACKGROUND OF THE INVENTION

Marginal oil wells, better known as stripper wells, are rarely operated by major oil companies because labor and pumping costs are close to the sales revenue produced by the well, which makes their operation uneconomic. Most oil and gas wells will slowly reduce its hydrocarbon output and finally end up as stripper wells. At this point, major companies will attempt to sell these wells to small companies or plug and abandon the well. Entrepreneurs who are able to scrounge up enough equipment and control their labor and operating costs operate these small companies; however, even their operating costs will slowly mount and the well will be abandoned.

The actual definition of a stripper well is difficult to come by, mainly because one person's (or company's) idea of a stripper well will differ from another's. Generally a well is considered to be a stripper well when it produces less than 10 barrels (420 U.S. gallons) of hydrocarbons per day. Stripper wells are important to the economy of any country for they allow that country to depend less on foreign supplies of hydrocarbons. This is particularly important in times of international political unrest.

With this in mind, it is desirable to develop and have available novel oil well production equipment that is relatively inexpensive and can be assembled from commercially available materials. Novel equipment will allow an increase in the profit gleaned from a stripper well. Novel equipment should have several design points in mind. One, it should be easy to work on and maintain. Two, it should be capable of operating at a low cost. Three, it should operate the stripper well in such a manner that the production rate will increase from marginal to profitable. Thus, properly designed novel production equipment will increase the number of profitable stripper wells and increase the overall supply of valuable hydrocarbons.

Many stripper wells use a pump-jack unit that in turn reciprocates a bottom hole pump. However, in a stripper, the flow of fluid into the wellbore is limited (hence the term "stripper"), and it is possible to run out of fluid. This condition is called "pump-off." Pump-off occurs whenever the pump system attempts to remove more fluid from the wellbore than is entering the wellbore from the producing formation. Pump-off leads to destruction of the downhole pump, the surface drive unit, and the intermediate connection between the downhole pump and the surface unit. The actual mechanism that causes destruction is termed "fluid pounding."

Fluid pounding is encountered whenever pump-off occurs. The lack of fluid in wellbore allows the introduction of compressible gases into the wellbore. These gases generally come from the formation or "outgas" from the wellbore fluid.

The downhole reciprocating pump consists of essentially two parts, a moving chamber or pump plunger within a downhole assembly or pump barrel. The pump barrel is attached to the production tubing, which runs inside the wellbore to the surface. The pump plunger lifts fluid from within the pump barrel into the production tubing and onto the surface. On the upstroke, the plunger chamber inlet valve is closed and fluid flows into the production tubing making its way to the surface; whereas, on the downstroke, the inlet valve is open. On the up stroke, wellbore fluids flow into the pump barrel through a valve, at its base, that opens on the upstroke and closes on the down stroke.

In normal circumstances, the pump plunger operates within a liquid. The liquid in turn provides damping to the plunger, on the downstroke, that absorbs the extension of the interconnection assembly between the plunger and the surface power unit. The interconnection assembly is generally a series of coupling rods—named "sucker rods." The interconnection assembly could easily be a wire cable. Materials expand (and contract) under load; thus, the interconnection assembly will elongate under load. Under usual circumstances, the downhole fluid absorbs the elongation.

Whenever pump-off occurs the pump accelerates into a gas rather than a fluid on the downstroke of the pump. There is little liquid to absorb or dampen the elongation, and the plunger strikes or pounds the bottom portion of the pump barrel. Hence the term—fluid pounding. The bottom of the plunger and the bottom of the barrel both contain fluid inlet/check valves. Fluid pounding ruins both valves. It also damages the interconnection assembly and the surface power unit. Much consideration must be given to avoid pump-off or fluid pounding.

There is one other cause of fluid pump-off. Many oil wells which are in the their maturity begin to produce gas along with the oil. This often results in fluid pounding even though the well is not pumping-off. Quite often these wells are shut down, simply because the cost of production, due to equipment problems, exceeds or reaches the revenue derived from the well.

In the current art, the pump barrel inlet (check) valve (sometimes called the standing valve), and the pump plunger inlet valve and outlet check valve (sometimes called the traveling valve) must operate against the wellbore hydrostatic head. Thus, when the plunger lifts up, its inlet valve closes, and the barrel inlet valve opens. The reduced pressure within the pump barrel caused by the raising of the plunger allows the inlet valve to open. At this point, formation fluid will enter the barrel. In a marginal well, this fluid is a gas-liquid fluid, which is compressible. On the down stroke, the barrel check valve will close. If the barrel fluid is incompressible (i.e., no entrained gas), then the increase pressure within the barrel, below the plunger, will force the outlet valve of the plunger to open as the plunger approaches the bottom of the pump barrel.

It must be remembered that as the plunger starts down, the fluid pressure below the plunger within the barrel is at or near formation pressure, which is lower than the hydrostatic head pressure above the plunger outlet valve. Thus, the outlet valve will not open until the pressure inside the pump barrel, below the plunger, exceeds the hydrostatic pressure of the wellbore. As the quantity of entrained gas builds up within the pump barrel below the plunger, the pressure within the pump barrel below the plunger will never exceed the hydrostatic head and the outlet and inlet valves on the plunger will not open. This is pump-off. Because there is little liquid to soften the downstroke, pounding occurs.

Madden in U.S. Pat. RE. 33,163 (4,781,547) discloses a Gas Equalizer for Downhole Pump. The Madden device operates in conjunction with the traveling valve. Basically the Madden device is designed to be fitted to an ordinary downhole pump and unseats the traveling ball check valve, or outlet check valve, during most of the downstroke of the plunger. In other words, the Madden device forces the upper check valve to open without relying on the increase in pressure within the plunger to force the valve open. Madden states that, by forcing the upper check valve to open, compressible fluid (gas) will be removed from the variable pump chamber on each downstroke of the pump. This then allows the gas to bubble through the production tubing to the surface. The Madden device cannot relieve the downhole liquid column pressure (wellbore hydrostatic head) on the downhole pump. Thus there is a limit to the suitability of the Madden device.

Heath, U.S. Pat. No. 2,949,861 discloses a Pumping Rig and Method. This device utilizes a downhole traveling valve; however, Heath is only concerned with reducing the effective weight of the sucker rods and does not address pounding or production problems associated with wellbore hydrostatic head.

The economic factors influencing the abandonment of a hydrocarbon well include operating costs, environmental issues, costs of abandonment, etc. Operating costs are set by many factors: labor price, distance from a maintenance base, available product distribution networks, workover cost, and equipment repair costs. The well must produce a profit. If any of the cost factors can be reduced, that well may become profitable. If maintenance is reduced, then the costs of labor and repair automatically come down. Since fluid pounding is a major maintenance headache in marginal wells, a technique to eliminate fluid pounding is needed. Thus there remains a need for a device that will reduce the effective wellbore hydrostatic head pressure and allow produced fluid to enter a downhole pump chamber.

SUMMARY OF THE INVENTION

The instant invention simply adds a valve—called a standing head valve—at the top of the pump barrel through which passes the lift connection (polished rod) that is attached to the pump plunger located within the barrel.

The standing head valve is designed to hold back the wellbore hydrostatic head pressure, contained within the production tubing, from the pump barrel (and the formation). Thus, at the start of the downstroke, the plunger valve only sees the formation pressure and readily opens to admit fluid. On the upstroke, the standing head valve is forced open, and the plunger fluid (formation fluid) passes through the standing valve into the wellbore. On the downstroke, the standing valve closes, and wellbore hydrostatic head pressure cannot be reflected into the pump barrel. Essentially, the standing head valve adds another check valve to the system.

The standing head valve is attached to the top of the pump barrel and a special smooth rod, or polished rod, passes through the center of the circular standing head valve. The polished rod attaches to the sucker rods that form the intermediate connection to the pump-jack on the surface. Of course other forms of intermediate connections could be used, e.g., a Cable Actuated Downhole Pump. (See for example the inventor's co-pending application based on his Provisional Application 60/220,414, filed on Jul. 24, 2000.)

The valve has essentially two functioning parts, which are integrated. One of the parts is the special ring shaped, or circular, check valve and the other part is the seal system through which the polished rod passes. Because the standing head valve is circular—set by the barrel of a standard pump—a special check valve is required. The preferred circular check valve is plurality of spring loaded metal balls operating within a plurality of apertures set about the circular check valve. The seal system is simple and comprises a smooth long rod (polished rod—available off-the-shelf) with very close tolerances between the rod and the inner diameter of the metal-to-metal seal.

Although the disclosure shows the use of the circular check valve in a wellbore employed as a standing head check valve. The concept could readily be employed in a service that requires pressure control or flow control about a location through which a reciprocating or rotating member must pass.

DETAILED DESCRIPTION OF THE EMBODIMENT

Figure 1:
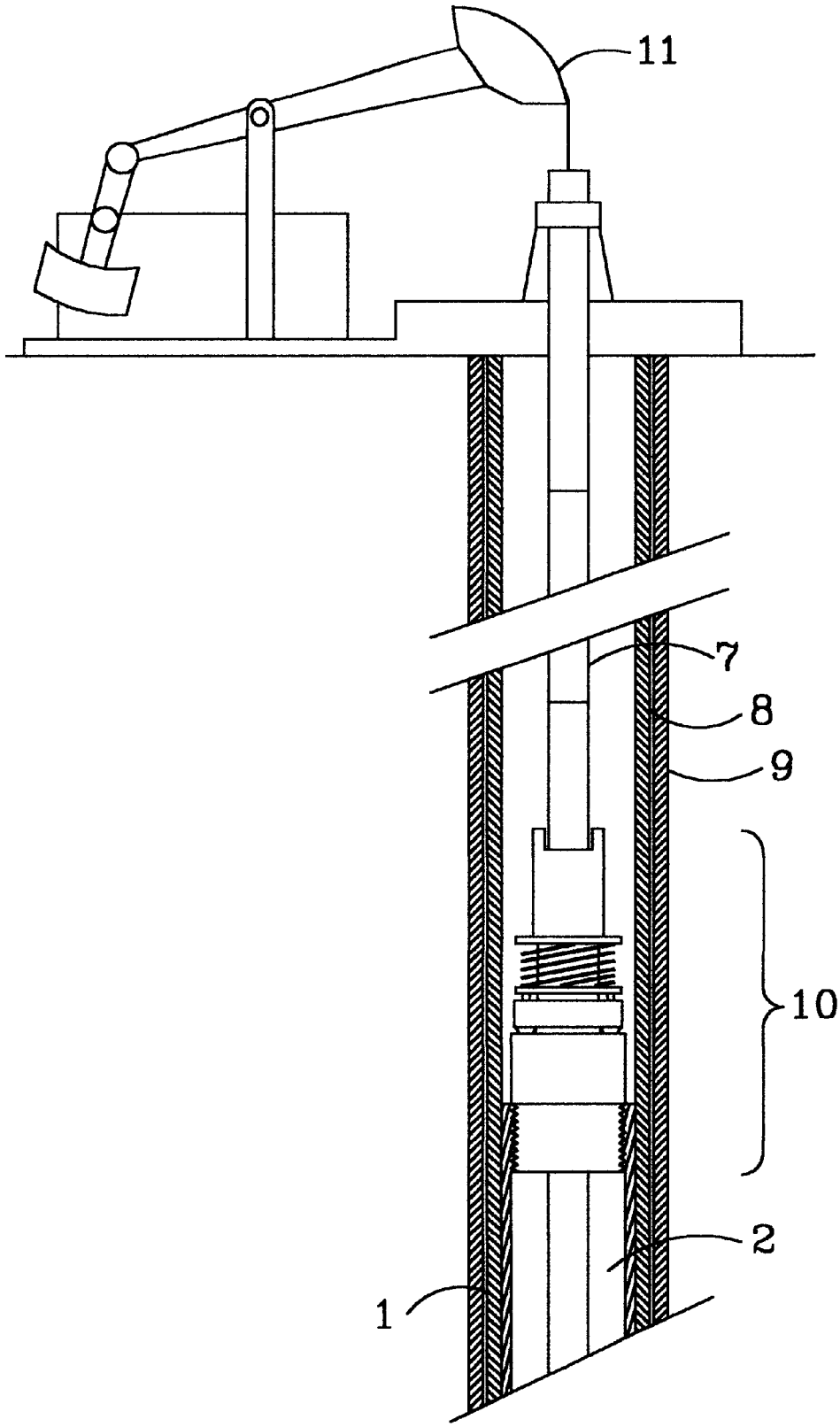
FIGS. 1 and 2 are a simplified illustration of a wellbore showing the production tubing, a series of sucker rods terminating in a polished rod that is connected to a pump plunger that in turn operates within a pump barrel, and with the instant invention connected to the top of the pump barrel.
Figure 2:
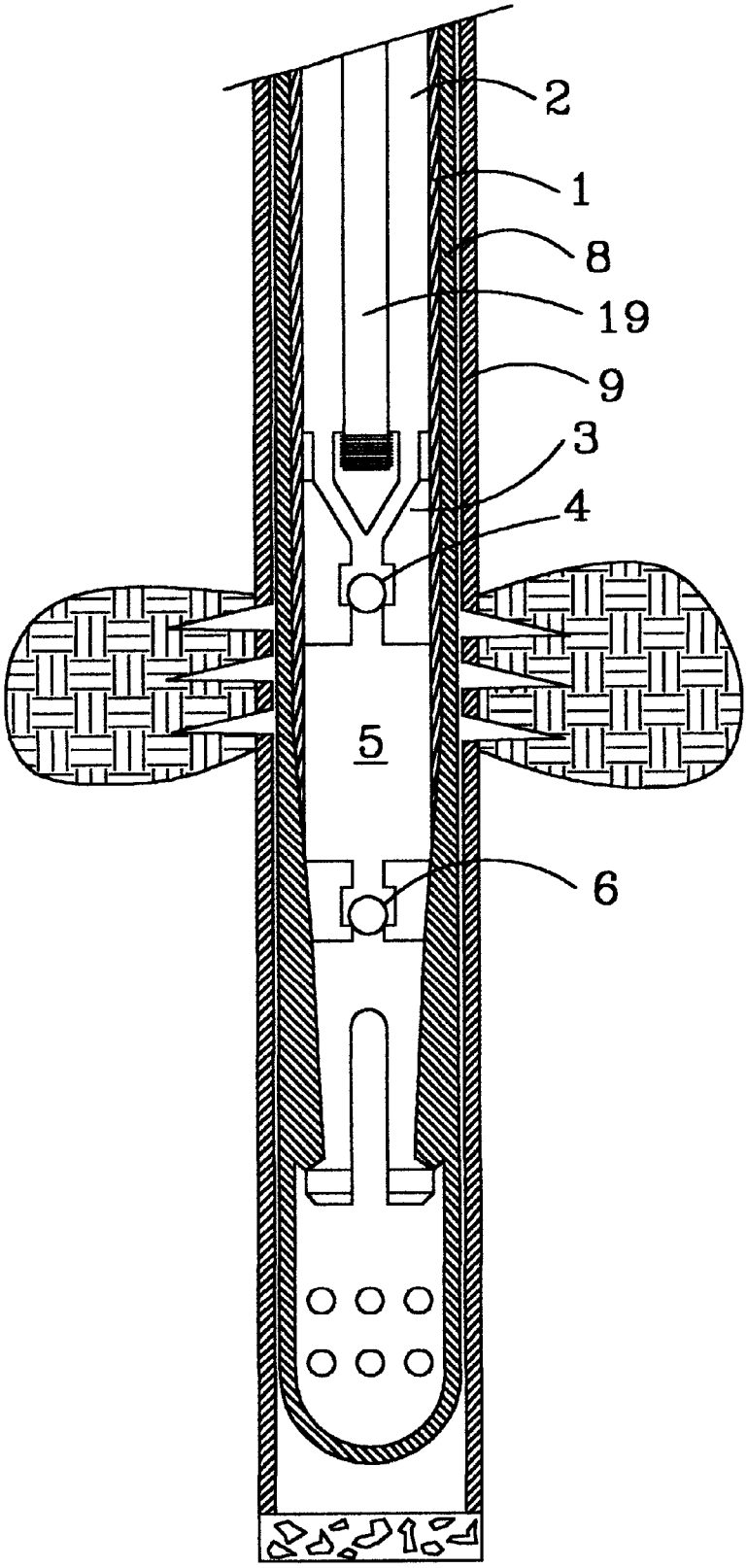

Referring to FIGS. 1 and 2, the instant invention, 10, is shown in place on a standard art reciprocating pump system, 11, as currently employed in the industry. As standard in the industry, a hydrocarbon well has a casing, 9, through which the production tubing, 8, extends. The downhole pump is usually attached to the production tubing and powered by a series of connected sucker rods, 7.

The standing head valve, generally 10, prevents the wellbore total hydrostatic pressure from resting on the top of the plunger, 3, and the plunger ball check or traveling valve, 4, on each downstroke. If the full wellbore hydrostatic head is present, gas can accumulate below the traveling valve, 4. Since gas is readily compressed—unlike a liquid—the plunger will travel on its downstroke to the bottom of the pump barrel without allowing the produced gas and oil (total fluid) to travel through the plunger into the upper plunger chamber, 2, located immediately above the plunger ball check valve (traveling valve), 4.

When the above condition occurs, destructive forces are induced and damage is inflicted on the pump unit. In addition, no additional fluid will be available to be lifted to the surface. I.e., no fluid enters the chamber in the downstroke for transmission in the upstroke. The instant invention, 10, is designed to hold all of the hydrostatic head pressure (that column of fluid which from the bottom of the wellbore to the surface) away from (or off of) the plunger, 3, and traveling valve, 4, during the downstroke. This allows the fluid (produced gas and liquid) below the plunger, 3, to pass by the traveling valve, 4, and into the upper plunger chamber, 2, on each downstroke.

On the upstroke, all the fluid (liquid and gas) in the plunger chamber, 2, is forced through the standing head valve, 10, and to the surface. The produced gas that is forced into the liquid column will act as "gas lift" in the fluid column. That is, the gas acts to lighten the column and reduce the overall hydrostatic head.

The instant invention, 10, when placed on the top of the pump barrel, 1, causes the following series of actions to occur:

A) On the upstroke, ball and seat valve 6 (the standing valve) opens allowing produced liquid and gas to enter the barrel below the plunger, 3, filling lower chamber, 5. Fluid that is in upper chamber, 2, is pushed through the standing head valve, 10, and onto the surface.

B) On the downstroke, ball and seat valve 6 (the standing valve) is closed, ball and seat valve 4 (the traveling valve) is opened, and plunger 3 travels towards the bottom allowing new fluid, from the formation, to fill the upper chamber, 2, from the lower chamber, 5. The pressure in the upper chamber, 2, will be the same as the pressure in the lower chamber, 5, (i.e., formation pressure) because the standing valve, 10, is holding back the hydrostatic head of the fluid column.

C) The above steps are repeated. The strokes per minute are set to match the rate of fluid production from the formation.

Remember that if gas and liquid are entering the pumping system, ball and check valve, 4, (the traveling valve) will be difficult to lift if there is no standing head valve, 10, in place to keep the hydrostatic pressure off of the ball. In a 3000 foot wellbore, the hydrostatic pressure will be approximately 1350 psi. This figure will vary with fluid density and temperature. In this example, the force required to open the traveling valve, 4, will exceed 1350 psi. Very often formation gas moves through the ball and seat valve (standing valve), 6, and it would take considerable plunger movement to build a pressure above 1350 psi; therefore, the traveling valve will remain closed and no fluid will enter the upper chamber. With the standing valve in place, there is no such backpressure and, therefore, fluid can flow more freely between the lower and upper chambers.

Refer now to FIGS. 3 through 7. The instant invention consists of a lower housing, 23, through which a plurality of flow apertures, 30, along with a lower, 33, and upper flow openings, 34, are bored.

Figure 3:
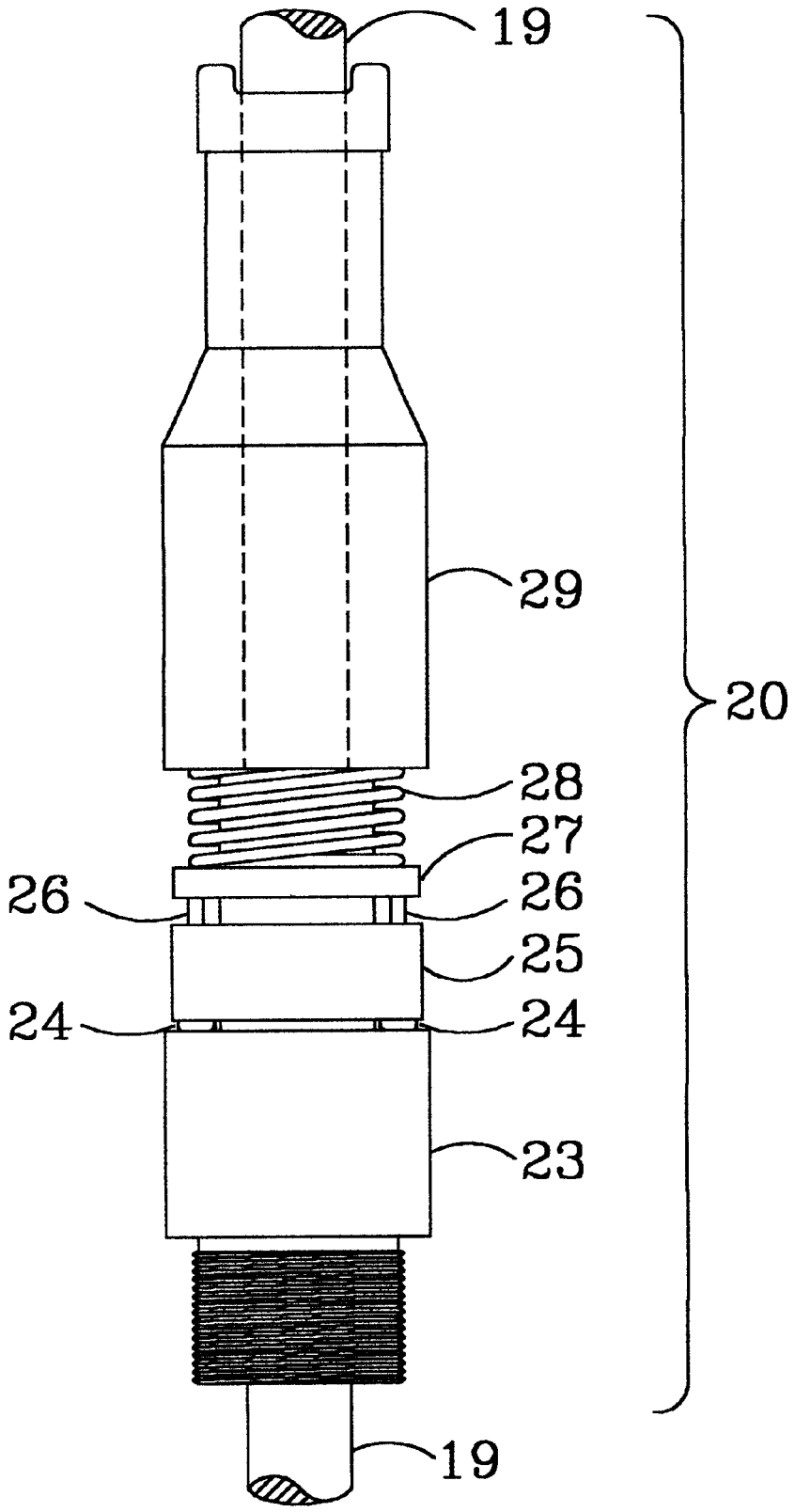
FIG. 3 is a side view of the instant device.

The lower housing, 23 screws onto the top of the pump barrel, 1 (see FIG. 1). As shown in FIG. 3, the threads of the lower housing will match a standard intermediate pump barrel. If the device is to be used with other standard pump barrels an adapter sub, 21, with inside threads or and adapter sub, 22, with outside threads is available. The proper adapter would be used along with a further standard oil industry sub for attachment to larger or smaller pump barrels.

An optional sand washer, 41, may be placed between the lower housing and the pump barrel. This washer forms a "seal" between the device and the production tubing, 8. The purpose of this seal is to keep 'flower sand' (an industry term for fine sand that is sometimes produced with hydrocarbons) from building up and packing around the device; thus, making it difficult to remove the pump/device assembly for servicing. By using a cup washer at this point, any flower sand build up will occur near the flow gap, 36, which is an area of high velocity flow. The high velocity flow will tend to stop build up of flower sand. The washer is made of a suitable elastomer chosen to retain elastic properties at the expected wellbore temperature (i.e., neoprene).

Figure 4:
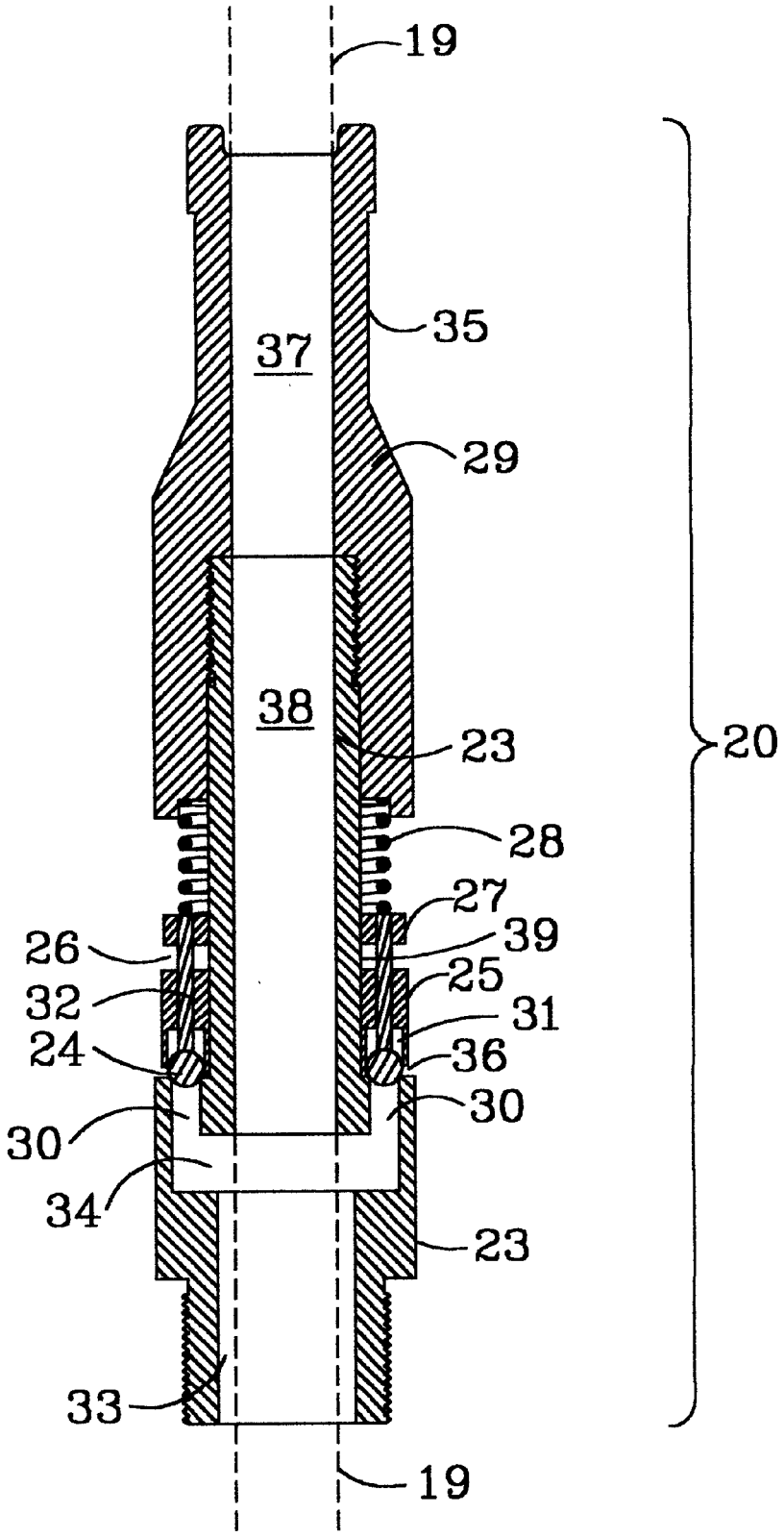
FIG. 4 is a cut-away side view of FIG. 3.
Figure 5:
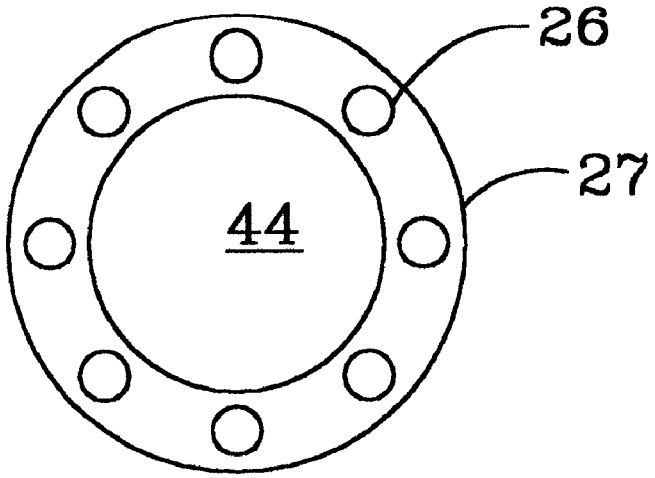
FIG. 5 is a cross-section of FIG. 7 taken at A—A.
Figure 6:
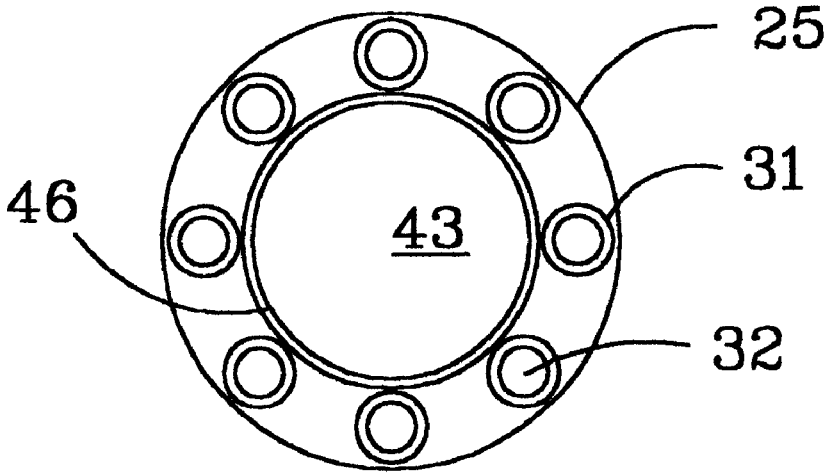
FIG. 6 is a cross-section of FIG. 7 taken at B—B.
Figure 7:
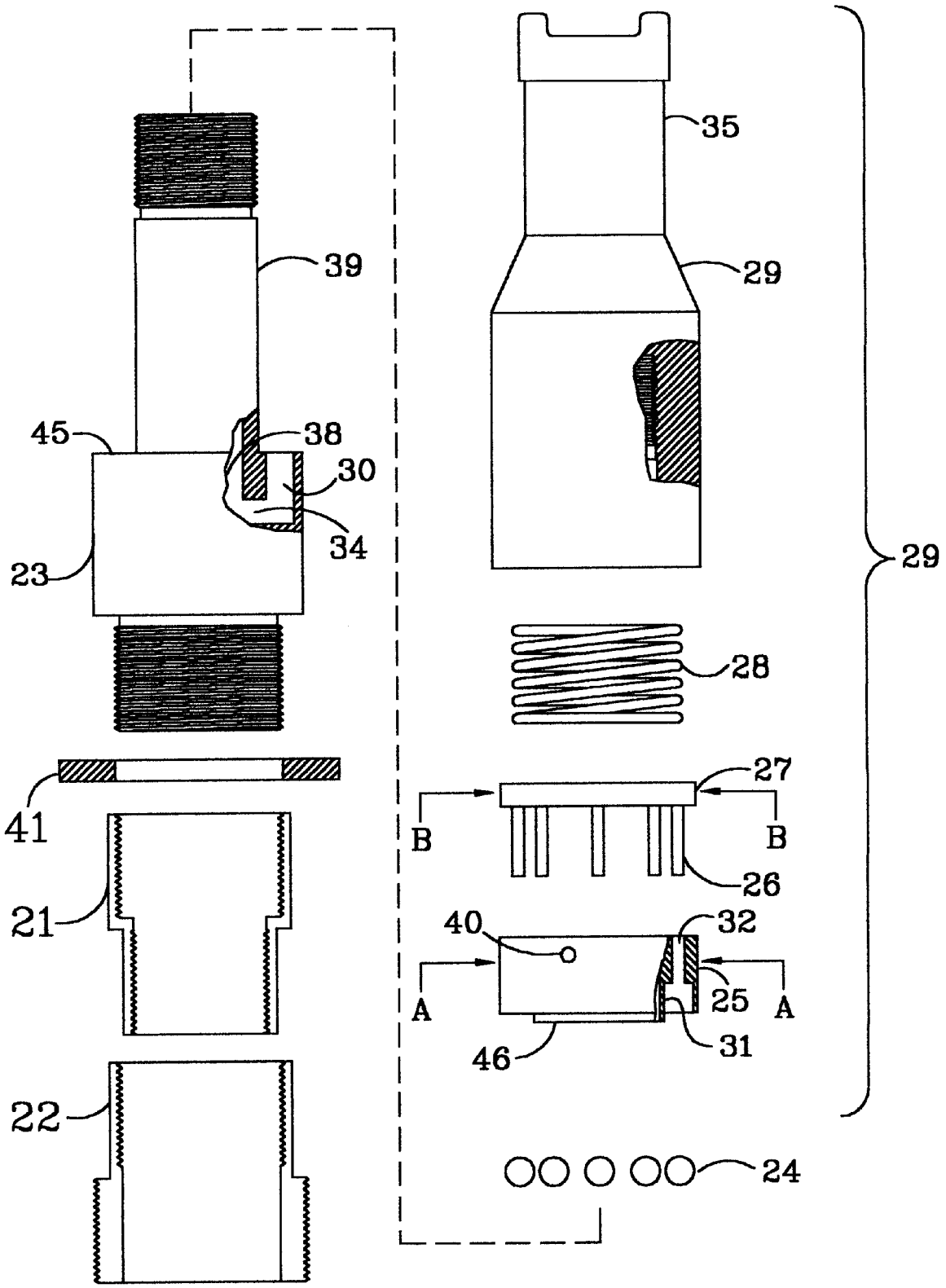
FIG. 7 is an exploded view of the instant device showing all parts.

A lower central aperture, 38, passes through the lower housing and receives a polished rod, 19. The lower central aperture, 38, the lower flow opening, 33, and the upper flow opening, 34, are axial to each other and in communication with each other as shown in FIG. 4. Essentially, in manufacturing the lower housing, the central aperture would be bored through the housing. The lower flow opening, 33, is formed by boring out (enlarging) the lowest section of the central aperture, 38, and the upper flow opening, 34, is a further enlargement of the central aperture to allow a plurality of flow apertures, 30, to be in communication the upper and lower flow openings. The flow apertures terminate in at the surface of the lower housing lip, 45, and a neck, 39, continues towards the top of the lower housing.

The polished rod (an off-the-shelf item), 19, connects the pump plunger, 9, (not a part of the invention) to the pump jack sucker rods, 7, or alternate reciprocating pump lifting system. Clearances between the central aperture and the polished rod are tight—carefully set so that the metal to metal surfaces act as a seal.

A plurality of flow apertures, 30, are formed within the lower housing as shown in FIGS. 4 and 7 through 9. This plurality of apertures is in communication with the inside of the plunger barrel (upper pump chamber 2) and the inside of the production tubing running to the surface. The flow apertures, 30, within the upper end of the lower housing, terminate in a plurality of check balls, 24. The upper end of flow apertures are slightly enlarged to accept the balls and act as a ball seat. In other words, when the balls rest against their respective aperture end, the aperture is sealed. (That is, hydrostatic pressure is stopped from affecting the system below the balls.)

To allow for upward movement of the balls (during the upstroke), yet prevent the balls from falling away from the valve, a ball housing, 25, is placed immediately above the lower housing radially about the neck, 39, of the lower housing. The ball housing has a plurality of apertures, 31, which accept the balls and align with the flow apertures, 30, in the lower housing. Thus the balls can move up and down within ball housing and within associated ball aperture, 31. Immediately above the ball apertures, 31, are associated finger apertures, 32. A locking pin or a locking screw, 40, is used to hold the ball housing in place on the valve body. The ball housing contains a ball housing central aperture, 43, which fits around the neck, 39, of the lower housing. To facilitate manufacturing, and ensure that a flow gap, 36, will exist, a ball housing lip, 46, is formed on the bottom side (nearest the lower housing when assembled). The ball housing lip rests on the surface of the lower housing lip, 45. The flow gap allows fluid that has passed through the flow apertures to escape away from the valve.

The locking pin or screw, 40, serves two purposes. The first is to stop rotation of the ball housing radially about the lower housing; thus, keeping the check balls over their associated flow aperture. The second is to hold the ball housing in place during assembly of the entire unit.

A finger housing, 27, is placed immediately above the ball housing radially about the neck, 39, of the lower housing. A plurality of ball fingers, 26, attached to a finger housing, 27, pass downwards, through the finger apertures, 32, in the ball housing, 25, and touch a respective ball, 24, in the ball housing, 25. The finger housing contains a finger housing central aperture, 44, which fits around the neck, 39, of the lower housing.

A spring, 28, is placed immediately above the ball finger housing, 27, radially about the neck, 39, of the lower housing. The spring and ball fingers act to hold the ball check valves against an associated flow aperture in the lower housing, thus forming a ball seal check valve. The spring is set to about 10 pounds, so that on the upstroke—with ZERO hydrostatic head—the internal pressure in the chamber must exceed roughly 20 pounds before the ball seals open. These numbers are for illustration only and will be set by the spring constant and the total area of the ball seals. (Set by the size and number of balls.) An optional washer, not shown, may be placed above the spring.

Figure 10:
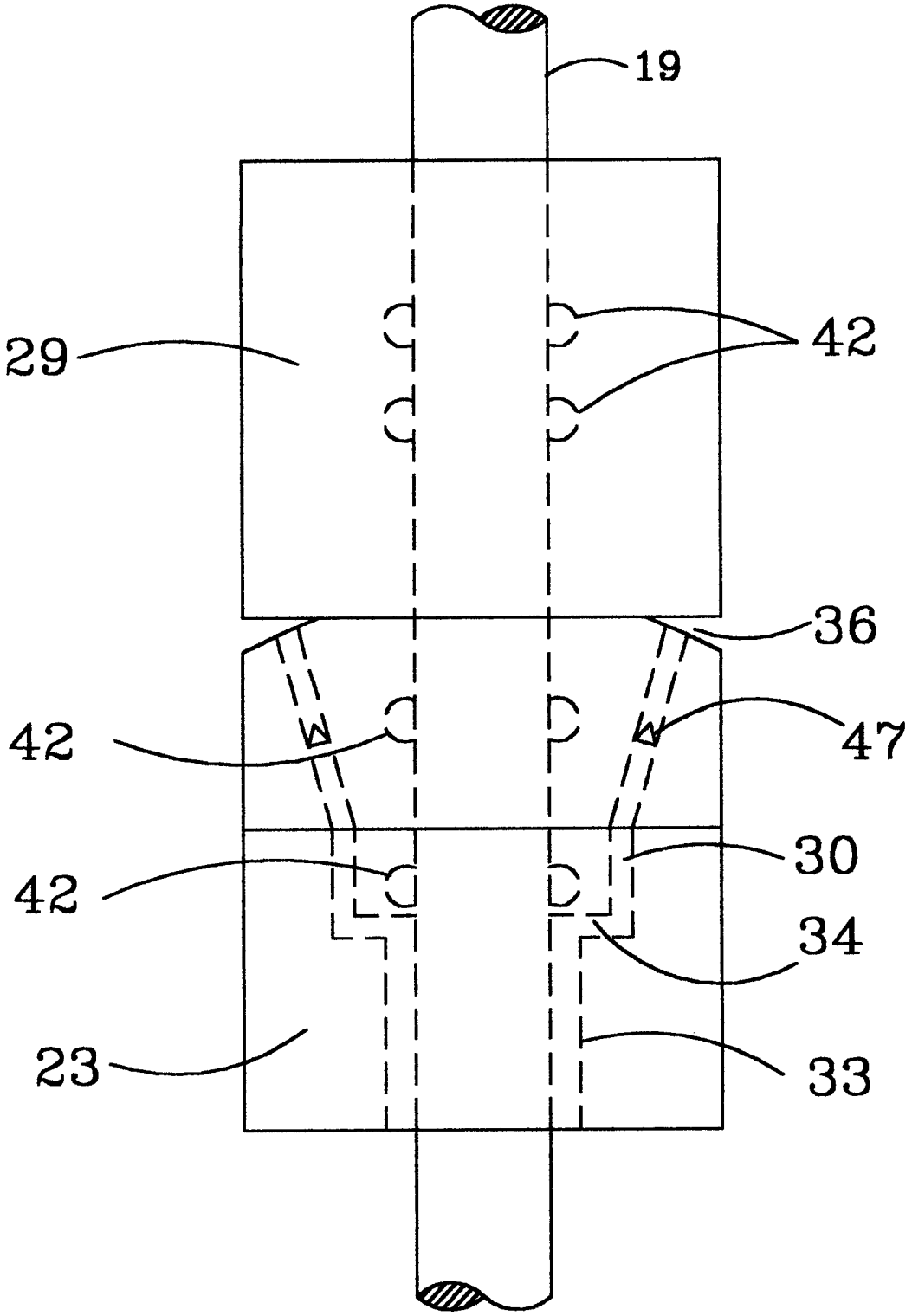
FIG. 10 is a conceptual figure of the circular check valve showing all optional seals and the check circular valve housing sandwiched between the upper and lower housing.

It should be noted that the check balls, 24, the ball housing, 25, the ball fingers, 26, the finger housing, 27, and the spring, 28, form an overall sub-assembly that is sandwiched between the lower and upper housings. (See conceptual drawing, FIG. 10.) Essentially this sub-assembly is a circular ball check valve. The sub-assembly can be replaced with a series of flapper valves co-located over the flow apertures, 30, to form an interesting alternate check valve. The flappers can optionally be spring loaded or allowed to operate under gravity. The flapper and the respective action of the flapper can be considered to be similar to a swing check valve—well known in the industry; but never used in this manner. Machining of this alternate mode is difficult and in light of the economics of the ball check valve is not the preferred embodiment.

One of the key concepts in this disclosure is the use of a circular check valve that allows for an external member (such as a rod or tube) to pass internally through a check valve that in turns holds back (checks) the reverse pressure or flow. Thus, any variant of the preferred circular check valve would fall within the scope of this disclosure. For example, other alternative check valves can use well known variants of linear (in line) check valves such as the common spring loaded plunger check valve. In the case of the alternate embodiments, the linear independent check valves, 47, (see FIG. 10) would be located in the "ball housing" and the finger and finger housing would be redundant. Thus, in any embodiment of the instant device, the circular check valve is essentially sandwiched between the upper and lower housing.

In the preferred device, the lower housing, 23, screws into the upper housing, 29, which retains the spring and finger housing. Alternate embodiments may have the parts welded or bolted together. The ball housing is retained by a pin or screw directly to the lower housing as previously explained.

The upper housing, 29, like the lower housing, contains an upper central aperture, 37, that passes axially through the upper housing and receives the polished rod, 19. The aperture is generally polished to form a metal-to-metal seal with the polished rod. (It is possible to use another seal system to effect a seal between the rod and the housing.) This central aperture extends the metal-to-metal seal between the polished rod and the standing head valve. This seal is critical, for it prevents the hydrostatic pressure from by-passing the ball seals.

The combined length of the lower central aperture in the lower housing, 38, and upper central aperture in the upper housing, 37, is set by standard metal-to-metal seal criteria. Note that these combined apertures form an overall common aperture, or a continuous conduit, through the circular check valve. (One industry standard sets one linear foot for 3000 feet of hydrostatic head as a seal criterion.) Optionally, a neoprene seal is placed above the sleeve to wipe the polished rod and prevent galling of the metal-to-metal seal by dirt, sand, or other particles found in wellbore fluids. The polished rod attaches to the sucker rods, 7, which form the intermediate connection to the pump-jack, 11, on the surface. Of course other forms of intermediate connections could be used, e.g., a Cable Actuated Downhole Pump, as discussed in the summary.

An optional seal system, 42, may be incorporated into the upper housing in order to provide additional sealing. The optional seal system shown uses two o-rings. Other seal systems, well known in the industry, may be employed. For example, if a rotating removable drive (passing through the center aperture) were used, simple o-ring seal would not be appropriate and special seals would have to be used. Such seals are seen to be a part of this disclosure and may be placed in the upper or lower housing, the circular check valve, both housings, or any combination thereof. (Again see conceptual drawing, FIG. 10.)

The upper housing also includes a fishing neck, or flange, 35. Such a flange is a requirement of the industry and serves as an attachment point for "fishing" the pump assembly from the wellbore when and if required.

Figure 8:
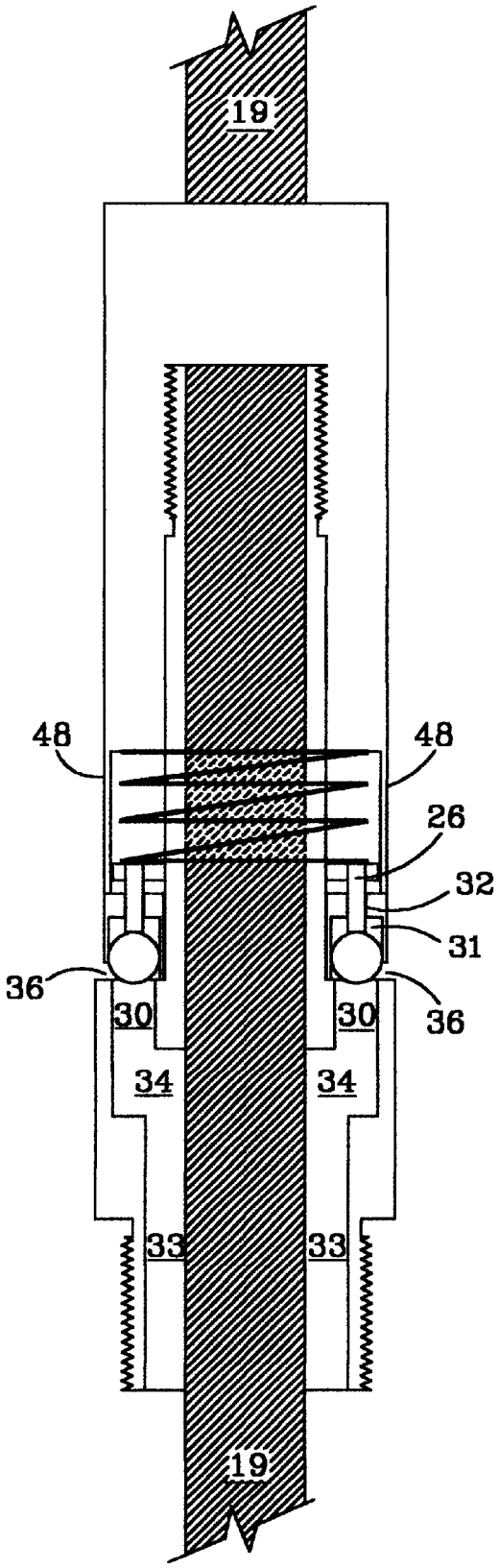
FIG. 8 is a mechanical drawing illustrating a prototype of the instant invention with the ball check valve in the closed position.
Figure 9:
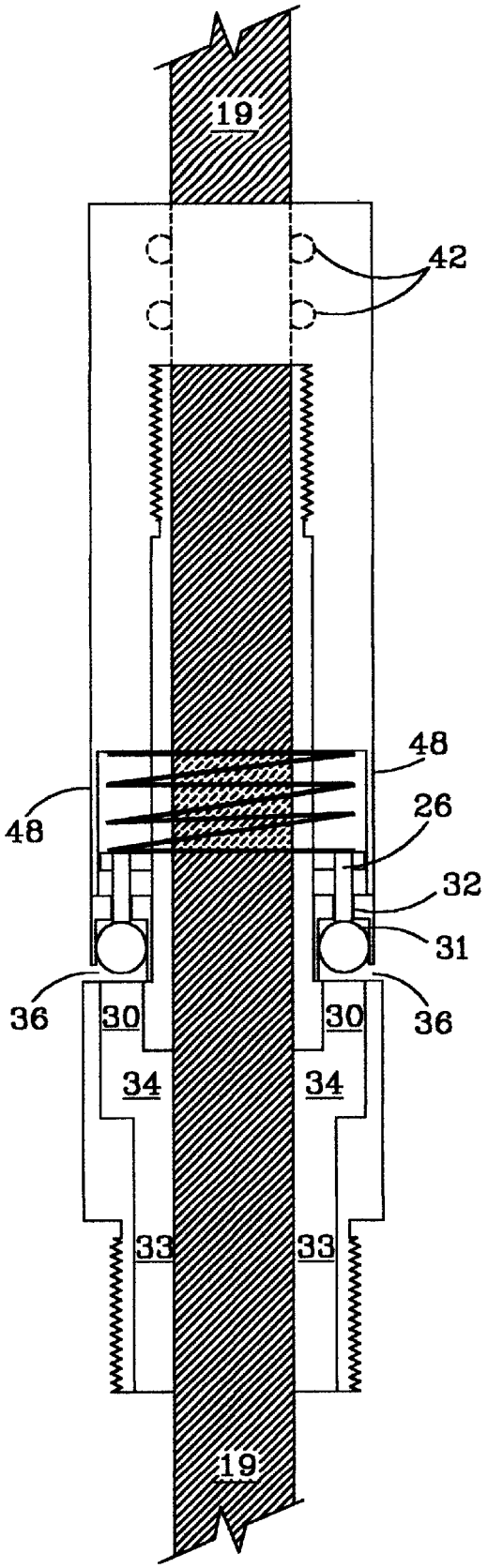
FIG. 9 is a mechanical drawing illustrating a prototype of the instant invention with the ball check valve in the open position. In addition this figure illustrates several options to the device.

FIG. 8 shows the ball check valves in their closed position, which is the expected position on a downstroke. FIG. 9 shows the ball check valves in their open position, which is the expected position on an upstroke. As explained, the ball valves are set to open, against the spring, whenever the pressure (under zero hydrostatic head) under the valve is greater than 20 pounds. Thus, the standing head valve would open on an upstroke whenever the upper pump chamber pressure exceeded 20 pounds plus the hydrostatic head and would reseat when that pressure dropped below 20 pounds plus the hydrostatic head. This valve may be adjusted by changing the spring constant and a person skilled in the art of reciprocal oil pump operation could easily determine the proper opening pressure and associated spring constant.

As shown in FIGS. 8 and 9, the upper housing includes a skirt, 48, to cover the spring, 28. The skirt is basically machined as the body is manufactured. The skirt extends the upper housing such that when the two housings are joined, the skirt covers the spring and keeps borehole materials (sand, grit, fluids, etc.) from contacting the spring, the finger housing, fingers, etc., and interfering with the operation thereof. The cavity, formed by the skirt between the upper and lower housing, in which the spring, fingers, and finger housing travel, is filled with grease during manufacture. Openings (with grease fittings or the equivalent) for the addition of grease during maintenance and to allow 'breathing' can be added to the skirt. The skirt would not be needed in the embodiments using alternate linear check valves.

As noted in the summary, the instant invention could be employed in a location where isolation of pressure or directional flow control is required while having an external member pass through the isolating device. For example, the circular check valve could be placed in water well service to control backflow from the surface (or water system) into the aquifer. Numerous pumping systems employ rotating pumps driven by a shaft from the surface that lift water to the surface. Once past the surface head, water then flows through a standard check valve and into the water system. The instant device could be employed downhole, above the aquifer, and protect the aquifer from pollution due to damaged casing or the like. In this circumstance, the fishing neck may not be required; however, it may be necessary to incorporate a seal assembly, 42, in the upper housing to further seal the external member that is passing through the common aperture. Other uses for the instant device, a circular check valve with a center, central, or common aperture (a continuous conduit from the top of the valve through the bottom of the valve), will become apparent as the device finds acceptance.

There has been disclosed the best and preferred mode for the instant invention. Any dimensions and/or numbers, if given, are for purposes of illustration only and should not serve to limit the disclosure. For example, the figures show eight balls; however, more or less would be utilized as required by valve size and conditions of use. Industry standard pumps, polished rods, and the like will set dimensions. An increase or decrease in the ball check apertures, the use of flap valves or other forms of check valves, and the like are within the concept of the disclosure. The key disclosure is a circular check valve system with a central opening, or common aperture, through which an external member (shaft, polished rod, or likewise) may pass.

Although the disclosure illustrates a downhole wellbore pump, the instant invention may find use with other equipment, requiring a central aperture or opening through which an external member may pass and in which control of hydrostatic head, high-pressure discharge head, or flow direction, is needed.

I claim:

1. A circular check valve comprising:

a lower housing having a first central axial aperture, an upper housing having a second central axial aperture connected to said lower housing, valve means for controlling flow of fluid incorporating a third central axial aperture sandwiched between said upper and lower housings such that said central axial apertures are axially aligned with and in communication with each other thereby axially forming a continuous conduit through said lower housing, said valve means, and said upper housing, an external member axially passing through said continuous conduit, first seal means located in said upper housing for effecting a fluid seal between said upper housing and said external member, second seal means located in said lower housing for effecting a fluid seal between said lower housing and said external member, and third seal means located in said valve means for effecting a fluid seal between said valve means and said external member.

2. A circular check valve comprising:

a lower housing having a first axial center line and further having therein a lower housing neck centered about said axial center line, an upper flow opening centered about said axial center line, a lower flow opening centered about said axial center line and in communication with said upper flow housing, a plurality of flow apertures each in communication with said upper flow opening, and a lower central aperture extending through said neck, whereby said upper flow opening, said lower flow opening and said lower central aperture axially align with said axial center line;

an upper housing having a second axial center line connected to said lower housing and further having therein an upper central aperture axially aligned with said axial center line;

valve means for controlling direction of fluid flow having a third axial center line and further having therein a central aperture axially aligned with said center line, and a plurality of check valves axially arranged about said central aperture;

wherein said valve means is sandwiched between said lower housing and said upper housing such that said plurality of check valves align with said plurality of flow apertures within said lower housing and said central aperture on said valve means encircles said lower housing neck, and such that when said lower and upper housing are attached to each other said lower central aperture and said upper central aperture are axially aligned with and in communication with each other forming a common aperture.

3. The device of claim 1 wherein an external member axially passes through said common aperture.

4. The device of claim 2 further incorporating seal means located in said upper housing for effecting a fluid seal between said upper housing and said external member whereby flow is diverted through said plurality of flow apertures.

5. The device of claim 1 wherein said upper housing has a top and further comprising a fishing flange formed within said upper housing near said top thereof.

6. The device of claim 2 wherein said upper housing has a bottom side and wherein said plurality of check valves further consist of:

a ball housing having a fourth axial center line and further having therein a plurality of balls, a plurality of ball apertures each containing one of said plurality of balls, and a plurality of finger apertures co-located with and in communication with said ball apertures, said finger apertures capable of receiving fingers;

a finger housing having a fifth axial center line, a top, and a bottom, and further having therein a plurality of fingers, equal in number to said plurality of balls, wherein said plurality of fingers are attached to said bottom of said finger housing pointing axially away from said bottom and in line with said fifth axial center line; and a spring located between said top of said finger housing and said bottom of said upper housing;

wherein said fingers of said finger housing pass through said finger apertures of said ball housing and come to rest on said balls.

7. A standing head valve for use in a wellbore comprising:

a lower housing having a first axial center line, a bottom, and further having therein a lower housing neck centered about said axial center line, an upper flow opening centered about said axial center line, a lower flow opening centered about said axial center line and in communication with said upper flow housing, a plurality of flow apertures each in communication with said upper flow opening and a lower central aperture extending through said neck, whereby said upper flow opening, said lower flow opening and said lower central aperture axially align with said axial center line;

an upper housing connected to said lower housing having a second axial center line and further having therein an upper central aperture axially aligned with said axial center line;

a ball housing having a third axial center line and further having therein a plurality of balls, a plurality of ball apertures each containing one of said plurality of balls, and a plurality of finger apertures, for receiving fingers, co-located with and in communication with said ball apertures;

a finger housing having a fourth axial center line, a top, and a bottom, and further having therein a plurality of fingers, equal in number to said plurality of balls, wherein said plurality of fingers are attached to said bottom of said finger housing pointing axially away from said bottom and in line with said fourth axial center line;

a spring;

wherein when said lower and upper housing are connected said lower central aperture and said upper central aperture are axially aligned with and in communication with each other forming a common aperture, wherein said ball housing, said finger housing, and said spring are sandwiched between said lower housing and said upper housing such that said plurality of balls align with said plurality of flow apertures within said lower housing, said plurality of fingers pass through said plurality of finger apertures and coming to rest on said balls within said ball housing, and wherein said ball housing, said finger housing, and said spring encircle said lower housing neck.

8. The device of claim 7 wherein an external member axially passes through said common aperture.

9. The device of claim 8 further incorporating seal means located in said upper housing for effecting a fluid seal between said upper housing and said external member whereby flow is diverted through said plurality of flow apertures.

10. The device of claim 8 further incorporating seal means located in said lower housing for effecting a fluid seal between said lower housing and said external member whereby flow is diverted through said plurality of flow apertures.

11. The device of claim 8 further incorporating seal means located in said ball housing for effecting a fluid seal between said ball housing and said external member whereby flow is diverted through said plurality of flow apertures.

12. The device of claim 7 wherein said upper housing has a top and further comprising a fishing flange formed within said upper housing near said top thereof.

13. The device of claim 7 wherein a sand washer is placed at said bottom of said lower housing.

14. The device of claim 7 wherein an adapter sub is attached to said bottom of said lower housing.

15. The device of claim 10 wherein said adapter sub further has a bottom and wherein a sand washer is placed at said bottom of said adapter sub.

* * * * *